US008154196B2

(12) United States Patent
Lee

(10) Patent No.: US 8,154,196 B2
(45) Date of Patent: Apr. 10, 2012

(54) ORGANIC LIGHT EMITTING DISPLAY WITH IMPROVED POWER SUPPLY CONTROL AND METHOD OF DRIVING THE SAME

(75) Inventor: Wook Lee, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 499 days.

(21) Appl. No.: 12/389,276

(22) Filed: Feb. 19, 2009

(65) Prior Publication Data

US 2009/0218937 A1 Sep. 3, 2009

(30) Foreign Application Priority Data

Feb. 28, 2008 (KR) ..... 10-2008-0018313

(51) Int. Cl.
*H01J 1/62* (2006.01)

(52) U.S. Cl. ..... 313/504; 313/505; 345/612

(58) Field of Classification Search ..... None
See application file for complete search history.

(56) References Cited

U.S. PATENT DOCUMENTS

| | | | | |
|---|---|---|---|---|
| 7,050,028 | B2 * | 5/2006 | Morita | 345/90 |
| 7,515,146 | B2 * | 4/2009 | Hayafuji | 345/204 |
| 2001/0028226 | A1 | 10/2001 | Malaviya et al. | |
| 2005/0179627 | A1 * | 8/2005 | Hayafuji et al. | 345/76 |
| 2007/0120781 | A1 | 5/2007 | Choi | |
| 2007/0139313 | A1 | 6/2007 | Choi | |
| 2011/0187693 | A1 * | 8/2011 | Chung | 345/211 |

FOREIGN PATENT DOCUMENTS

| | | |
|---|---|---|
| CN | 1979615 A | 6/2007 |
| CN | 1987969 A | 6/2007 |
| JP | 2001-255845 | 9/2001 |
| JP | 2003-005715 | 1/2003 |
| JP | 2004-163673 | 6/2004 |
| JP | 2005-017934 | 1/2005 |
| JP | 2005-221700 | 8/2005 |
| JP | 2005-227412 | 8/2005 |
| JP | 2005-274742 | 10/2005 |
| JP | 2005-315919 | 11/2005 |

(Continued)

OTHER PUBLICATIONS

SIPO Certificate of Patent for Invention, dated May 11, 2011 of the Chinese Patent Application No. 200910118059.X, 3 pages.

*Primary Examiner* — Arnel C Lavarias
(74) *Attorney, Agent, or Firm* — Christie, Parker & Hale, LLP

(57) ABSTRACT

An organic light emitting display having an improved image quality. The organic light emitting display includes a data driver for supplying a data signal to data lines; a scan driver for supplying a scan signal to scan lines; pixels at crossing regions between the data lines and the scan lines; a power source unit for generating a first power; a first voltage divider for dividing the first power to generate a first reference power; a second voltage divider for dividing a power from an external power source to generate a second reference power; and a switch to transmit one of the first reference power or the second reference power to the data driver. Each of the pixels includes an organic light emitting diode that emits light when a current flows from the first power to the second power.

8 Claims, 2 Drawing Sheets

FOREIGN PATENT DOCUMENTS

| | | |
|---|---|---|
| JP | 2005-338838 | 12/2005 |
| JP | 2006-079044 | 3/2006 |
| JP | 2006-091839 | 4/2006 |
| KR | 10-2006-0018391 | 3/2006 |
| KR | 10-2006-0078588 | 7/2006 |
| KR | 10-2006-0099102 | 9/2006 |
| KR | 10-2007-0027671 | 3/2007 |
| KR | 10-2007-0028141 | 3/2007 |
| KR | 10-2007-0121865 | 12/2007 |
| KR | 10-2008-0002572 | 1/2008 |

* cited by examiner

ORGANIC LIGHT EMITTING DISPLAY WITH IMPROVED POWER SUPPLY CONTROL AND METHOD OF DRIVING THE SAME

CROSS-REFERENCE TO RELATED APPLICATION

This application claims priority to and the benefit of Korean Patent Application No. 10-2008-0018313, filed on Feb. 28, 2008, in the Korean Intellectual Property Office, the entire content of which is incorporated herein by reference.

BACKGROUND OF THE INVENTION

1. Field of the Invention

The present invention relates to an organic light emitting display and a method of driving the same.

2. Description of Related Art

In recent years, various flat panel displays have been developed having reduced weight and volume in comparison to the cathode ray tube display. These flat panel displays include a liquid crystal display (LCD), a field emission display (FED), a plasma display panel (PDP), an organic light emitting display, etc.

Amongst the various flat panel displays, the organic light emitting display displays an image by using organic light emitting diodes which generate light by the recombination of electrons and holes. The organic light emitting display has a rapid response time and a low power consumption.

However, a reference power (Vref) supplied to a data driver and a first power (ELVDD) generated in a power source unit are supplied by separate power sources in conventional organic light emitting displays. When the reference power (Vref) and the first power (ELVDD) are provided by separate power sources, it is difficult to charge a desired voltage in a storage capacitor (Cst) due to voltage ripples.

More particularly, a first power (ELVDD) generated in the power source unit and a data signal generated by the reference power (Vref) show a ripple in which a voltage repeatedly increases and decreases. Therefore, a power may be charged in the storage capacitor (Cst) at a point of time when the voltage of the data signal increases, and the voltage of the first power (ELVDD) decreases in certain pixels. Also, a power may be charged in the storage capacitor (Cst) at a point of time when the voltage of the data signal decreases, and the voltage of the first power (ELVDD) increases in the other pixels. Therefore, although the same data signal is supplied to the pixels, lights generated by the pixels may have different luminance.

Also, when the first power (ELVDD) or the reference power (Vref) experiences noises from the outside environment, it is difficult to display a desired image since the noises directly affect the luminance of the displayed image.

SUMMARY OF THE INVENTION

An aspect according to an exemplary embodiment of the present invention provides an organic light emitting display having improved image quality.

Also, another aspect according to an exemplary embodiment of the present invention provides a method for driving an organic light emitting display.

An embodiment of the present invention provides an organic light emitting display including a data driver for supplying a data signal to data lines; a scan driver for supplying a scan signal to scan lines; pixels at crossing regions between the data lines and the scan lines; a power source unit for supplying a first power source; a first voltage divider for dividing the first power to generate a first reference power; a second voltage divider for dividing a power from an external power source to generate a second reference power; and a switch for transmitting one of the first reference power or the second reference power to the data driver.

The switch may include a first switch between the data driver and the first voltage divider and a second switch between the data driver and the second voltage divider. The second switch may be configured to turn on during an initial period in which the power from the external power source is inputted to the organic light emitting display, and the first switch may be configured to turn on during a period in which light is generated by the pixels. Also, the second switch may be configured to turn on when a power source coupled to the organic light emitting display is shut off, and the first switch may be configured to turn off when the power source coupled to the organic light emitting display is shut off. Here, the organic light emitting display according to an embodiment of the present invention may further include a controller for controlling turn-on and turn-off of the first switch and the second switch. Furthermore, the data driver may be configured to receive a voltage from one of the first reference power or the second reference power, and divide the received voltage to generate a plurality of gamma voltages.

Also, another embodiment of the present invention provides a method for driving an organic light emitting display that includes pixels for displaying an image while a current flows from a first power to a second power via an organic light emitting diode included in each of the pixels. The method includes: transmitting a second reference power to a data driver during an initial period in which a power from an external power source is inputted to the organic light emitting display, the second reference power being generated by dividing the power from the external power source; transmitting a first reference power to the data driver during a period in which an image is displayed by the pixels, the first reference power being generated by dividing the first power; generating a plurality of gamma voltages in the data driver utilizing the first reference power, selecting a gamma voltage of the plurality of gamma voltages as a data signal and supplying the selected gamma voltage to the pixels; and displaying the image by the pixels, the image corresponding to the data signal.

The method for driving an organic light emitting display may further include: transmitting the second reference power to the data driver when a power source coupled to the organic light emitting display is shut off.

The organic light emitting display according to the embodiments of the present invention and the driving method thereof may display an image with a desired luminance without any effect caused by voltage ripples since a reference power source is generated using a first power source. Also, the organic light emitting display according to the embodiments of the present invention and the driving method thereof may prevent the deterioration of image quality cause by the noises, which are supplied to the first power source, since the reference power source are also affected by the noises.

According to still another embodiment, an organic light emitting display includes: a data driver for supplying a data signal to data lines; a scan driver for supplying a scan signal to scan lines; pixels at crossing regions between the data lines and the scan lines; a power source unit for providing a first power; a first voltage divider for voltage dividing the first power to generate a first reference power; a second voltage divider for voltage dividing an external power to generate a second reference power; and a switch for transmitting one of the first reference power or the second reference power to the data driver. Each of the pixels includes an organic light emitting diode that generates light while a current flows from the first power via the organic light emitting diode to a second power.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1:
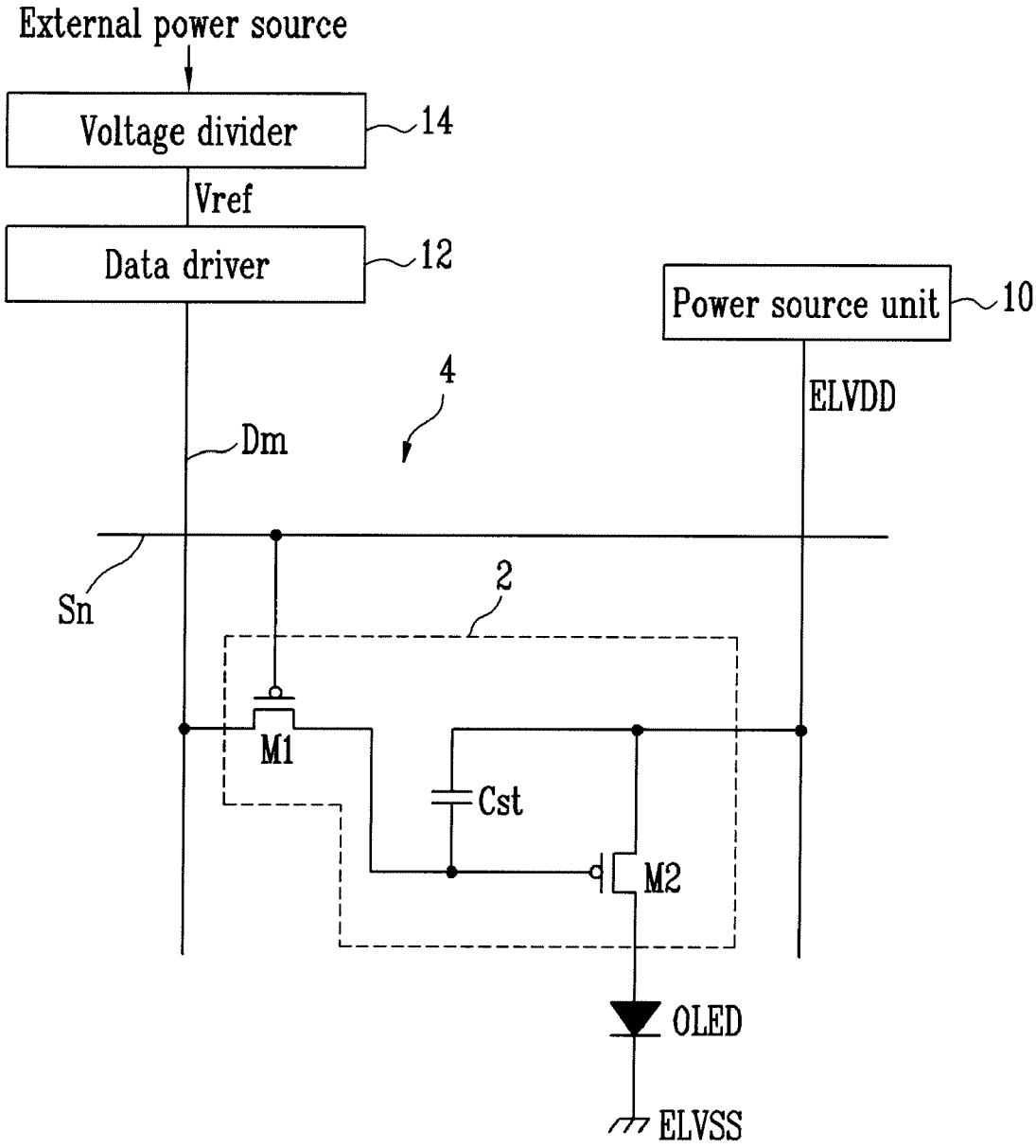
FIG. 1 is a schematic diagram showing a conventional pixel.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to the complete understanding of the invention are omitted for clarity. Also, like reference numerals refer to like elements throughout.

FIG. 1 is a schematic diagram schematically showing a pixel in a conventional organic light emitting display.

Referring to FIG. 1, a pixel 4 of the conventional organic light emitting display includes an organic light emitting diode (OLED) and a pixel circuit 2 coupled to a data line (Dm) and a scan line (Sn) to control the OLED.

An anode electrode of the OLED is coupled to the pixel circuit 2, and a cathode electrode of the OLED is coupled to a second power (ELVSS). The OLED generates light with a luminance (e.g., a predetermined luminance) corresponding to an electric current supplied from the pixel circuit 2.

The pixel circuit 2 controls an amount of the electric current supplied to the OLED to correspond to a data signal supplied from the data line (Dm) when a scan signal is supplied to the scan line (Sn). In FIG. 1, the pixel circuit 2 includes a second transistor (M2), a first transistor (M1), and a storage capacitor (Cst). Here, the second transistor (M2) is coupled between a first power (ELVDD) and the OLED. The first transistor (M1) is coupled between the second transistor (M2) and the data line (Dm), and the scan line (Sn). Also, the storage capacitor (Cst) is coupled between a gate electrode and a first electrode of the second transistor (M2).

A gate electrode of the first transistor (M1) is coupled to the scan line (Sn), and a first electrode of the first transistor (M1) is coupled to the data line (Dm). A second electrode of the first transistor (M1) is coupled to a terminal of the storage capacitor (Cst). Here, the first electrode of the first transistor (M1) can be one of a source electrode or a drain electrode, and the second electrode of the first transistor (M1) is the other electrode of the source electrode or the drain electrode. For example, when the first electrode is a source electrode, the second electrode is a drain electrode. The first transistor (M1) coupled to the scan line (Sn) and the data line (Dm) is turned on when a scan signal is supplied to its gate electrode from the scan line (Sn), thereby supplying a data signal, supplied from the data line (Dm), to the storage capacitor (Cst). Thus, the storage capacitor (Cst) is charged with a voltage corresponding to the data signal.

A gate electrode of the second transistor (M2) is coupled to a terminal of the storage capacitor (Cst), and its first electrode is coupled to the other terminal of the storage capacitor (Cst) and the first power (ELVDD). A second electrode of the second transistor (M2) is coupled to the anode electrode of the OLED. The second transistor (M2) controls the amount of an electric current to correspond to the voltage value stored in the storage capacitor (Cst), and the electric current flows from the first power (ELVDD) to the second power (ELVSS) via the OLED. Here, the OLED generates light corresponding to the amount of the electric current supplied from the second transistor (M2).

The first power (ELVDD) is generated from the power source unit 10 and supplied to the pixel 4. For example, the power source unit 10 can include DC/DC converters.

The data driver 12 generates a data signal and supplies the generated data signal to the data line (Dm). Here, the data driver 12 generates a gamma voltage at various voltage levels (e.g., a large number of voltage levels) using the reference power (Vref) supplied from a voltage divider 14, and supplies, as a data signal, one of the various voltage levels of the gamma voltage to the data line (Dm).

The voltage divider 14 includes resistors, and divides the power of an external power source (for example, a power supplied from a battery) to generate a reference power (Vref).

Figure 2:
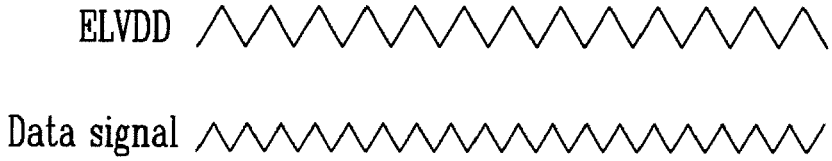
FIG. 2 is a diagram showing ripples of the voltages of a first power source and a reference power source as shown in FIG. 1.

The first power (ELVDD) generated in the power source unit 10 and the data signal generated by the reference power (Vref) each have a voltage ripple in which a voltage repeatedly increases and decreases as shown in FIG. 2. Therefore, when the same data signal is supplied to the pixels, lights generated by the pixels may have different luminance.

Figure 3:
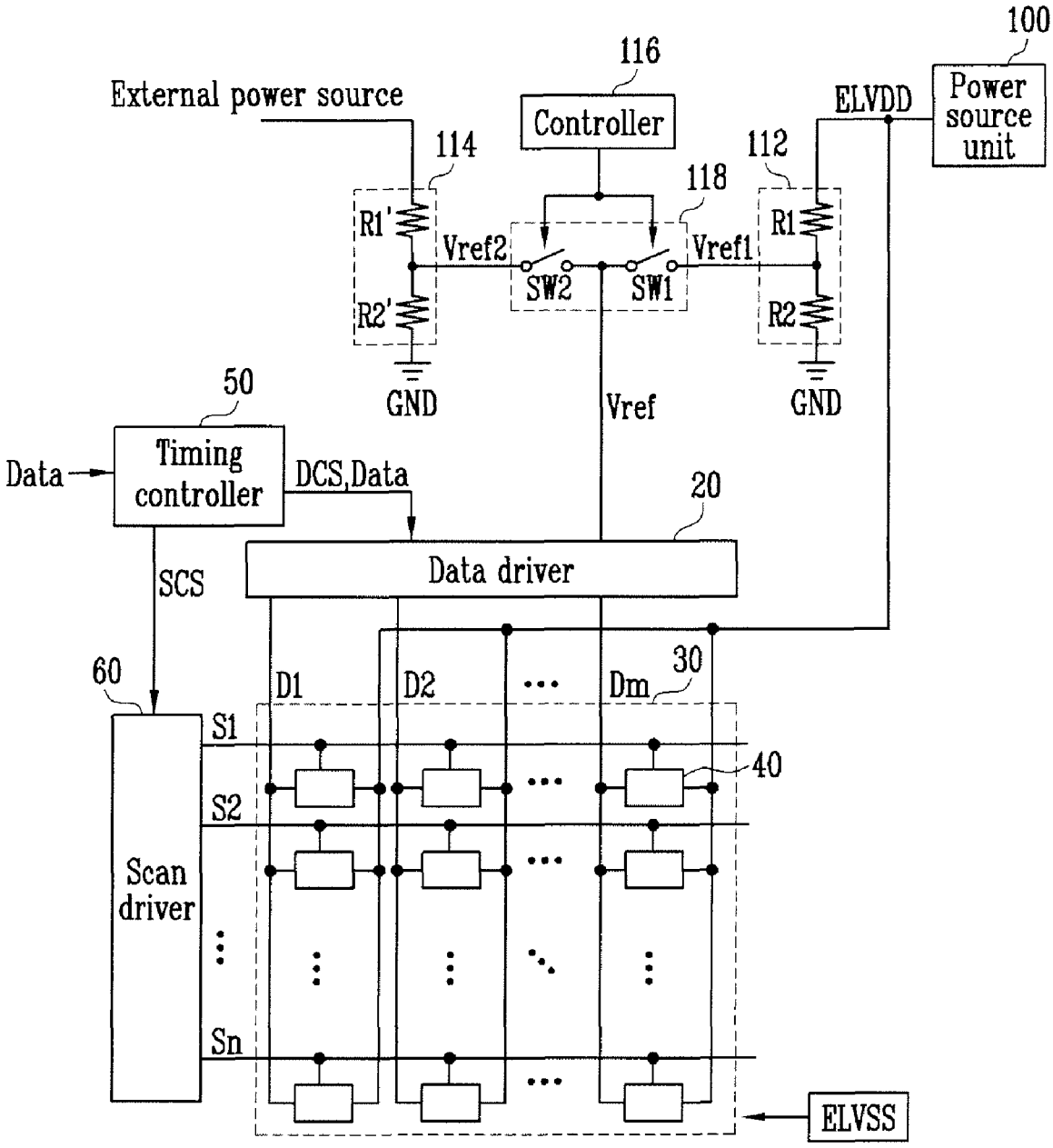
FIG. 3 is a block diagram showing an organic light emitting display according to one exemplary embodiment of the present invention.

FIG. 3 is a block diagram showing an organic light emitting display according to an exemplary embodiment of the present invention.

Referring to FIG. 3, the organic light emitting display according to an exemplary embodiment of the present invention includes a display unit 30, a scan driver 60, a data driver 20, and a timing controller 50. Here, the display unit 30 includes a plurality of pixels 40 coupled to scan lines (S1 to Sn) and data lines (D1 to Dm). The scan driver 60 drives the scan lines (S1 to Sn), and the data driver 20 drives the data lines (D1 to Dm). Also, the timing controller 50 controls the scan driver 60 and the data driver 20.

Also, the organic light emitting display according to an exemplary embodiment of the present invention includes a power source unit 100, a first voltage divider 112, a second voltage divider 114, a switch 118, and a controller 116. Here, the power source unit 100 generates a first power (ELVDD), and the first voltage divider 112 generates a first reference power (Vref1) using the first power (ELVDD). The second voltage divider 114 generates a second reference power (Vref2) using an external power source. Also, the switch 118 supplies, as a reference power (Vref), one of the first reference power (Vref1) or the second reference power (Vref2), which are generated in the first voltage divider 112 and the second voltage divider 114 respectively, to the data driver 20. The controller 116 controls the switch 118.

The display unit 30 receives the first power (ELVDD) supplied from the power source unit 100 and the second power (ELVSS) supplied from the outside of the display unit 30, and transmit the powers to the pixels 40. The pixels 40 receiving the first power (ELVDD) and the second power (ELVSS) are selected when a scan signal is supplied to the pixels 40, thereby emitting light with luminance corresponding to the data signal.

Here, each of the pixels 40 includes an OLED (not shown) and a pixel circuit (not shown) that supplies an electric current to the OLED. The pixel circuit includes at least two transistors and at least one capacitor. The pixel circuit controls the amount of the electric current to correspond to the data signal, and the electric current flows from the first power (ELVDD) to the second power (ELVSS) via the OLED. The OLED generates light with a luminance (e.g., a predetermined luminance) that corresponds to the amount of the electric current supplied from the pixel circuit.

FIG. 1 shows that the pixel 4 is coupled to one scan line and one data line for the convenience of description, but the present invention is not particularly limited thereto. For example, a configuration of the pixel circuit 2 in the pixel 4 may have other configurations known to a person skilled in the art. For example, at least two scan lines and light emitting control lines (not shown) may be additionally coupled to the pixel 4 to correspond to the configuration of the pixel circuit 2.

Referring back to FIG. 3, the scan driver 60 sequentially supplies a scan signal to the scan lines (S1 to Sn). When the scan signal is sequentially supplied to the scan lines (S1 to Sn), the pixels 40 are sequentially selected by line.

The data driver 20 receives the reference power (Vref) from the switch 118 and divides the reference power (Vref) into a plurality (e.g., a large number) of voltage levels to generate a plurality (e.g., a large number) of gamma voltages. In some embodiments, a gamma generation unit (not shown) may be additionally included inside the data driver 20. The data driver 20 generates the plurality of gamma voltages using the reference power (Vref). The data driver 20 selects one gamma voltage from the plurality of gamma voltages to generate a data signal in every channel according to the bits of data (Data) supplied from the timing controller 50. The data driver 20 supplies a data signal to the data lines (D1 to Dm) whenever a scan signal is supplied to the pixels 40. Then, a data signal is supplied to the pixels 40 selected by the scan signal.

The timing controller 50 generates a data drive control signal (DCS) and a scan drive control signal (SCS) to correspond to the synchronization signals supplied from the outside. The data drive control signal (DCS) generated in the timing controller 50 is supplied to the data driver 20, and the scan drive control signal (SCS) is supplied to the scan driver 60. The timing controller 50 rearranges the externally supplied data (Data) and supplies the data (Data) to the data driver 20.

The power source unit 100 generates the first power (ELVDD) and supplies the generated first power (ELVDD) to the display unit 30 and the first voltage divider 112. For example, the power source unit 100 includes DC/DC converters.

The first voltage divider 112 divides a voltage of the first power (ELVDD) to generate the first reference power (Vref1). Here, the first voltage divider 112 includes a first resistor (R1) and a second resistor (R2), both of which are disposed between the first power (ELVDD) and a ground (GND) (e.g., a ground power source).

The second voltage divider 114 divides power received from an external power source (for example, a voltage supplied from a battery) to generate a second reference power (Vref2). Here, the second voltage divider 114 includes a first resistor (R1') and a second resistor (R2'), both of which are disposed between the external power source and the ground (GND). Here, a voltage of the second reference power (Vref2) is set to the same voltage value as the first reference power (Vref1).

The switch 118 outputs one of the first reference power (Vref1) or the second reference power (Vref2) into the data driver 20. Here, the switch 118 includes a first switch (SW1) disposed between the first voltage divider 112 and the data driver 20; and a second switch (SW2) disposed between the second voltage divider 114 and the data driver 20.

The controller 116 controls turn-on and turn-off of the first switch (SW1) and the second switch (SW2). For example, the controller 116 turns on the second switch (SW2) during an initial period where a power source is inputted into the organic light emitting display. The controller 116 turns on the first switch (SW1) during the other period where an image is displayed on the display unit 30.

When the power source is inputted into the organic light emitting display, a reset operation is carried out while a power source is sequentially supplied according to a previously determined order. Here, it takes a period of time to generate a normal first power (ELVDD) in the power source unit 100. Therefore, the controller 116 turns on the second switch (SW2) to supply the second reference power (Vref2) to the data driver 20 until a normal voltage of the first power (ELVDD) is generated in the power source unit 100.

Furthermore, an unnecessary image may be undesirably displayed on the display unit 30 when the unstable first reference power (Vref1) is supplied to the data driver 20 during an initial period that a power source is inputted into the organic light emitting display. Therefore, it is possible to prevent the unnecessary image from being displayed on the display unit 30 by supplying the second reference power (Vref2) to the data driver 20 during the initial period where a power source is inputted to the organic light emitting display.

Also, the controller 116 turns on the first switch (SW1) to supply the first reference power (Vref1) to the data driver 20 when a normal voltage of the first power (ELVDD) is generated in the power source unit 100, that is, when an image is displayed on the display unit 30.

In addition, the controller 116 turns off the first switch (SW1) but turns on the second switch (SW2) even when a power source coupled to the organic light emitting display is shut off. Then, the second reference power (Vref2) is supplied to the data driver 20 when the power source coupled to the organic light emitting display is shut off, and therefore it is possible to express a black color without any erroneous phenomenon such as flickers when the organic light emitting display is turned off.

An operation of the organic light emitting display is described in detail, as follows. First, the second switch (SW2) is turned on during an initial period where a power source is inputted into the organic light emitting display to supply the second reference power (Vref2) to the data driver 20.

After the initial period, the first switch (SW1) is turned on to supply the first reference power (Vref1) to the data driver 20. The data driver 20 receiving the first reference power (Vref1) generates a plurality (e.g., a large number) of gamma voltages using the first reference power (Vref1), selects, as a data signal, one of the gamma voltages in every channel and supplies the selected gamma voltage to the data lines (D1 to Dm). Then, an image corresponding to the data signal is displayed on the display unit 30.

The point of time where a voltage ripple occurs (i.e., voltage increases and decreases) on the first reference power (Vref1) is at the same point of time as that of the first power (ELVDD) since the first reference power (Vref1) is generated from the first power (ELVDD). Therefore, the data signal generated from the first reference power (Vref1) has a voltage ripple that occurs at the same point of time as the first power (ELVDD). Thus, the storage capacitor (Cst) charged with a voltage corresponding to the voltage difference between the first power (ELVDD) and the data signal may be stably charged with a desired voltage.

Also, when external noises are inputted into the first power (ELVDD), the same noises are inputted into the first reference power (Vref1). Therefore, voltages of the first power (ELVDD) and the first reference power (Vref1) are changed to the same extent by the external noises, and therefore it is possible to prevent or reduce the degradation of the image quality caused by the noises.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display comprising:

a data driver for supplying a data signal to data lines;

a scan driver for supplying a scan signal to scan lines;

pixels at crossing regions between the data lines and the scan lines;

a power source unit for supplying a first power;

a first voltage divider for dividing the first power to generate a first reference power;

a second voltage divider for dividing a power from an external power source to generate a second reference power; and a switch for transmitting one of the first reference power or the second reference power to the data driver, wherein each of the pixels comprises an organic light emitting diode that generates light while a current flows from the first power via the organic light emitting diode to a second power.

2. The organic light emitting display according to claim 1, wherein the switch comprises:

a first switch between the data driver and the first voltage divider; and a second switch between the data driver and the second voltage divider.

3. The organic light emitting display according to claim 2, wherein the second switch is configured to turn on during an initial period in which the power from the external power source is inputted to the organic light emitting display, and the first switch is configured to turn on during a period in which light is generated by the pixels.

4. The organic light emitting display according to claim 3, further comprising a controller for controlling turn-on and turn-off of the first switch and the second switch.

5. The organic light emitting display according to claim 2, wherein the second switch is configured to turn on when the power source unit coupled to the organic light emitting display is shut off, and the first switch is configured to turn off when the power source unit coupled to the organic light emitting display is shut off.

6. The organic light emitting display according to claim 5, further comprising a controller for controlling turn-on and turn-off of the first switch and the second switch.

7. The organic light emitting display according to claim 1, wherein the data driver is configured to receive a voltage from one of the first reference power or the second reference power, and divide the received said voltage to generate a plurality of gamma voltages.

8. The organic light emitting display according to claim 1, wherein the first reference power and the second reference power have a same voltage value.

* * * * *